US009741484B2

(12) United States Patent
Yamamoto et al.

(10) Patent No.: US 9,741,484 B2
(45) **Date of Patent: *Aug. 22, 2017**

(54) LAMINATED COIL COMPONENT

(71) Applicant: MURATA MANUFACTURING CO., LTD., Kyoto (JP)

(72) Inventors: Atsushi Yamamoto, Kyoto (JP); Akihiro Nakamura, Kyoto (JP); Yuko Fujita, Kyoto (JP); Tomoyuki Ankyu, Kyoto (JP); Osamu Naito, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/287,656

(22) Filed: Oct. 6, 2016

(65) Prior Publication Data

US 2017/0025217 A1 Jan. 26, 2017

Related U.S. Application Data

(63) Continuation of application No. 14/105,062, filed as application No. PCT/JP2012/062758 on May 18, 2012, now Pat. No. 9,490,060.

(30) Foreign Application Priority Data

Jun. 15, 2011 (JP) ..... 2011-133091

(51) Int. Cl.
*H01F 27/255* (2006.01)
*H01F 1/34* (2006.01)
(Continued)

(52) U.S. Cl.
CPC ..... *H01F 27/255* (2013.01); *H01F 1/14716* (2013.01); *H01F 1/344* (2013.01);
(Continued)

(58) Field of Classification Search
CPC ..... H01F 5/00; H01F 27/28
(Continued)

(56) References Cited

U.S. PATENT DOCUMENTS 3,798,059 A 3/1974 Astle et al.
6,459,351 B1 10/2002 Maki et al.
(Continued)

FOREIGN PATENT DOCUMENTS

CN 101615499 A 12/2009
EP 1220591 A2 7/2002
(Continued)

OTHER PUBLICATIONS

International Search Report; PCT/JP2012/062758; Aug. 7, 2012.
(Continued)

*Primary Examiner* — Tsz Chan
(74) *Attorney, Agent, or Firm* — Studebaker & Brackett PC

(57) ABSTRACT

A laminated coil component includes a magnetic body part made of a Ni—Zn-based ferrite material and a coil conductor containing Cu as a main component, which is wound into a coil shape, and the coil conductor is embedded in the magnetic body part to form a component base. The component base is divided into a first region near the coil conductor and a second region other than the first region. The grain size ratio of the average crystal grain size of the magnetic body part in the first region to the average crystal grain size of the magnetic body part in the second region is 0.85 or less. The molar content of CuO in the ferrite raw material is set to 6 mol % or less, and firing is performed in a reducing atmosphere in which the oxygen partial pressure is an equilibrium oxygen partial pressure of Cu—$Cu_2O$ or less.

15 Claims, 5 Drawing Sheets

(51) Int. Cl.

| | |
|---|---|
| ***H01F 27/28*** | (2006.01) |
| ***H01F 41/04*** | (2006.01) |
| ***H01F 1/147*** | (2006.01) |
| ***H01F 27/29*** | (2006.01) |
| *H01F 3/14* | (2006.01) |

(52) U.S. Cl.
CPC ..... *H01F 27/2804* (2013.01); *H01F 27/29* (2013.01); *H01F 41/041* (2013.01); *H01F 41/046* (2013.01); *H01F 3/14* (2013.01); *H01F 2027/2809* (2013.01)

(58) Field of Classification Search
USPC ..... 336/200, 232
See application file for complete search history.

(56) References Cited

U.S. PATENT DOCUMENTS

| | | | |
|---|---|---|---|
| 2001/0024739 | A1 | 9/2001 | Mizoguchi et al. |
| 2001/0025944 | A1 | 10/2001 | Kobayashi et al. |
| 2002/0086145 | A1 | 7/2002 | Yazaki et al. |
| 2004/0052932 | A1 | 3/2004 | Yazaki et al. |
| 2004/0084131 | A1 | 5/2004 | Konoue et al. |
| 2005/0199852 | A1 | 9/2005 | Takenoshita |
| 2009/0021337 | A1 | 1/2009 | Sato |
| 2009/0051476 | A1 | 2/2009 | Tada et al. |
| 2009/0103272 | A1 | 4/2009 | Watanabe |
| 2009/0231077 | A1 | 9/2009 | Liao et al. |
| 2010/0085140 | A1 | 4/2010 | Tanaka et al. |
| 2010/0194511 | A1 | 8/2010 | Kobayashi et al. |
| 2010/0201473 | A1 | 8/2010 | Konoue et al. |
| 2010/0283447 | A1 | 11/2010 | Tachibana et al. |
| 2010/0289609 | A1 | 11/2010 | Liao et al. |
| 2010/0308949 | A1 | 12/2010 | Lim et al. |
| 2011/0095856 | A1 | 4/2011 | Nakajima et al. |
| 2011/0102124 | A1 | 5/2011 | Matsushita |
| 2011/0128109 | A1 | 6/2011 | Tada et al. |
| 2012/0105188 | A1 | 5/2012 | Lim et al. |
| 2014/0047704 | A1 | 2/2014 | Lim et al. |

FOREIGN PATENT DOCUMENTS

| | | | |
|---|---|---|---|
| EP | 1983531 | A1 | 10/2008 |
| EP | 2141137 | A1 | 1/2010 |
| JP | S63-102215 | A | 5/1988 |
| JP | 02-260405 | A | 10/1990 |
| JP | 05-175032 | A | 7/1993 |
| JP | 06-045307 | U | 6/1994 |
| JP | H07-201570 | A | 8/1995 |
| JP | 2694757 | B2 | 12/1997 |
| JP | 2001-176717 | A | 6/2001 |
| JP | 2002-187769 | A | 7/2002 |
| JP | 2002-255637 | A | 9/2002 |
| JP | 2002-289421 | A | 10/2002 |
| JP | 2003-272912 | A | 9/2003 |
| JP | 2005-244183 | A | 9/2005 |
| JP | 2006-219306 | A | 8/2006 |
| JP | 2006-237438 | A | 9/2006 |
| JP | 2010-192890 | A | 9/2010 |
| JP | 2010-278075 | A | 12/2010 |
| KR | 2010-0094456 | A | 8/2010 |
| WO | 2007/074580 | A1 | 7/2007 |
| WO | 2010/007858 | A1 | 1/2010 |
| WO | 2010/126332 | A2 | 11/2010 |

OTHER PUBLICATIONS

Written Opinion of the International Searching Authority; PCT/JP2012/062758; Aug. 7, 2012.

An Office Action; "Notice of Reasons for Rejection," issued by the Japanese Patent Office on Apr. 28, 2015, which corresponds to Japanese Patent Application No. 2013-520485 and is related to U.S. Appl. No. 14/105,062; with English language translation.

The extended European search report issued by the European Patent Office on Jun. 10, 2015, which corresponds to European Patent Application No. 12800256.5-1556 and is related to U.S. Appl. No. 14/105,062.

The extended European search report issued by the European Patent Office on Jul. 2, 2015, which corresponds to European Patent Application No. 15162012.7-1556 and is related to U.S. Appl. No. 14/105,062.

"Notification of the Second Office Action" issued by the State Intellectual Property Office of the People's Republic of China on Mar. 4, 2016, which corresponds to Chinese Patent Application No. 201280029328.5 and is related to U.S. Appl. No. 14/105,062; with English language translation.

LAMINATED COIL COMPONENT

CROSS REFERENCE TO RELATED APPLICATIONS

The present application is a continuation of U.S. patent application Ser. No. 14/105,062 filed on Dec. 12, 2013, which is a continuation of International Application No. PCT/JP2012/062758 filed on May 18, 2012, and claims priority to Japanese Patent Application No. 2011-133091 filed on Jun. 15, 2011, the entire contents of each of these applications being incorporated herein by reference in their entirety.

TECHNICAL FIELD

The technical field relates to a laminated coil component and more particularly to a laminated coil component such as a laminated inductor having a magnetic body part made of a ferrite material and a coil conductor containing Cu as a main component.

BACKGROUND

Heretofore, laminated coil components using ferrite-based ceramics such as Ni—Zn having a spinel type crystal structure, are widely used, and ferrite materials are also actively developed.

This kind of laminated coil component has a structure in which a conductor part wound into a coil shape is embedded in a magnetic body part, and usually the conductor part and the magnetic body part are formed by simultaneous firing.

In the above laminated coil component, since the magnetic body part made of a ferrite material has a coefficient of linear expansion different from that of the conductor part containing a conductive material as a main component, stress-strain caused by the difference in the coefficient of linear expansion is internally produced during the process of cooling after firing. When a rapid change in temperature is produced or external stress is loaded due to reflow treatment in mounting a component on a substrate or the like, the above-mentioned stress-strain varies, and therefore magnetic characteristics such as inductance fluctuate.

Then, Japanese Unexamined Utility Model Application Publication No. 6-45307 (Patent Document 1) (see, claim 2, paragraph 0024, FIG. 2, and FIG. 7) proposes a laminated chip inductor in which a framework of a laminated chip is formed by laminated ceramic sheets, a coil conductor is formed in the laminated chip by an internal conductor, and a start end and a terminal end of the coil conductor are separately connected to external electrode terminals, and in which the ceramic sheet is a magnetic sheet, and a doughnut-shaped non-magnetic region is formed in the laminated chip so as to embrace the internal conductor excluding extraction parts to the external electrode terminals.

In this Patent Document 1, after preparing the magnetic sheet, a non-magnetic paste is applied onto the magnetic sheet to form a non-magnetic film with a predetermined pattern, and thereafter, a printing treatment is performed in turn plural times using a magnetic paste, a paste for an internal conductor and a non-magnetic paste, and thereby, a laminated chip inductor is obtained.

In Patent Document 1, by employing a non-magnetic paste for the ceramic in contact with the coil conductor, the magnetic characteristics are prevented from fluctuating even when the stress-strain is internally produced by simultaneous firing and thereafter thermal shock is given or external stress is loaded.

On the other hand, in this kind of a laminated coil component, it is important that stable inductance is attained even when a large current is applied, and it is necessary to this end to have such a DC superposition characteristic that a reduction in inductance is suppressed even when a large DC current is applied.

However, since the laminated coil components such as a laminated inductor form a closed magnetic circuit, magnetic saturation is easily generated to decrease the inductance when a large current is applied, and desired DC superposition characteristics cannot be attained.

Hence, Japanese Patent No. 2694757 (Patent Document 2) (see, claim 1, FIG. 1, etc.) proposes a laminated coil component provided with a conductor pattern having an end connected between magnetic body layers and wound in a direction of lamination in the form of superimposition, and provided with layers of a material having lower magnetic permeability than the magnetic body layer, which are in contact with conductor patterns of both ends in the direction of lamination and located on the inside of the conductor patterns.

In Patent Document 2, by disposing a layer made of a material (for example, a Ni—Fe-based ferrite material having a small Ni content, or a non-magnetic material) having lower magnetic permeability than the magnetic body layer on the outside of the conductor pattern, a magnetic flux is prevented from concentrating at a corner on the inside of the conductor pattern at an end, and the magnetic flux is dispersed toward the center of the main magnetic path, and thereby, the occurrence of magnetic saturation is prevented to improve inductance.

Further, Japanese Patent Laid-open Publication No. 2006-237438 (Patent Document 3) (see, claim 1, paragraph 0007) proposes a laminated bead in which a magnetic body layer and a conductor pattern are laminated, and an impedance element is formed in a base, wherein a sintering modifier for adjusting the sinterability of the magnetic body layer is mixed in a conductive paste.

In Patent Document 3, the sintering modifier is composed of $SiO_2$ with which a silver powder is coated, $SiO_2$ contains silver in an amount of 0.05 to 0.3 wt %, and the conductive paste including the mixed sintering modifier is printed on a magnetic body layer to form a conductor pattern.

Further, in Patent Document 3, by mixing the sintering modifier in the conductive paste, since the sintering modifier is moderately diffused in the magnetic body, it is possible to delay the progress of sintering of the magnetic body near the conductor pattern compared with other portions, and thereby, a magnetically inactive layer is formed in a manner of functional gradient. That is, by delaying the progress of sintering of the magnetic body near the conductor pattern compared with other portions, the grain size of the magnetic body between the conductor patterns or near the conductor pattern becomes smaller than that in other portions to enable formation of a low-magnetic permeability layer, and a magnetically inactive portion is formed. Thereby, it is intended to improve the DC superposition characteristics to a large current region in a high-frequency band to prevent the deterioration of magnetic characteristics.

SUMMARY

The present disclosure provides a laminated coil component which has excellent thermal shock resistance that the fluctuation of inductance is small even when thermal shock is given or external stress is loaded, and has excellent DC superposition characteristics without requiring a complicated process.

A laminated coil component according to the present disclosure includes a magnetic body part made of a ferrite material and a conductor part wound into a coil shape. The conductor part is embedded in the magnetic body part to form a component base, which is divided into a first region near the conductor part and a second region other than the first region. The grain size ratio of the average crystal grain size of the magnetic body part in the first region to the average crystal grain size of the magnetic body part in the second region is 0.85 or less, and the conductor part contains Cu as a main component.

In a more specific embodiment, the content of Cu in the ferrite material may be 6 mol % or less (including 0 mol %) in terms of CuO.

In another more specific embodiment, in the above laminated coil component, the weight ratio of Cu contained in the second region to Cu contained in the first region may be 0.6 or less (including 0) in terms of CuO.

In yet another more specific embodiment of the above laminated coil component, the ferrite material may contain a Mn component.

In still another more specific embodiment of the above laminated coil component, the ferrite material may contain Mn in an amount of 1 to 10 mol % in terms of $Mn_2O_3$ In another more specific embodiment of the laminated coil component, the ferrite material may contain a Sn component.

In another more specific embodiment of the laminated coil component, the Sn component may be 1 to 3 parts by weight in terms of $SnO_2$ with respect to 100 parts by weight of a main component.

Moreover, in still another more specific embodiment of the above laminated coil component, the component base may be formed by being sintered in an atmosphere of an equilibrium oxygen partial pressure of Cu—$Cu_2O$ or less.

In yet another more specific embodiment, the component base laminated coil component may include a non-magnetic sheet provided across the conductor part and having a major surface perpendicular to an axial direction of the coil shape.

In another more specific embodiment, in the component base, the second region substantially surrounds the first region.

An embodiment of a method for manufacturing a laminated coil component according to the present disclosure includes a magnetic sheet preparation step of preparing a magnetic sheet from a Ni—Zn-based ferrite raw material powder, a paste preparation step of preparing a conductive paste containing Cu as a main component, a coil pattern formation step of forming a coil pattern on a surface of the magnetic sheet by using the conductive paste, a laminated formed body preparation step of laminating the magnetic sheets provided with the formed coil pattern in a predetermined direction to prepare a laminated formed body, and a firing step of firing the laminated formed body in a firing atmosphere in having an oxygen partial pressure of the equilibrium oxygen partial pressure of Cu—$Cu_2O$ or less.

In a more specific embodiment of the above method of manufacturing a laminated coil component, the firing step may be performed within a firing temperature range of 900 to 1050° C.

In another more specific embodiment of the above method of manufacturing a laminated coil component, the content of Cu in the ferrite material may be 6 mol % or less, inclusive of 0 mol %, in terms of CuO.

In yet another more specific embodiment of the above method of manufacturing a laminated coil component, the weight ratio of Cu contained in the second region to Cu contained in the first region may be 0.6 or less, inclusive of 0, in terms of CuO.

In still another more specific embodiment of the above method of manufacturing a laminated coil component, the ferrite material may contain a Mn component.

In a further specific embodiment of the above method of manufacturing a laminated coil component, the ferrite material may contains Mn in an amount of 1 to 10 mol % in terms of $Mn_2O_3$.

In another more specific embodiment of the above method of manufacturing a laminated coil component, the ferrite material may contain a Sn component.

In a further specific embodiment of the above method of manufacturing a laminated coil component, the Sn component may be 1 to 3 parts by weight in terms of $SnO_2$ with respect to 100 parts by weight of a main component.

DETAILED DESCRIPTION

Figure 1:
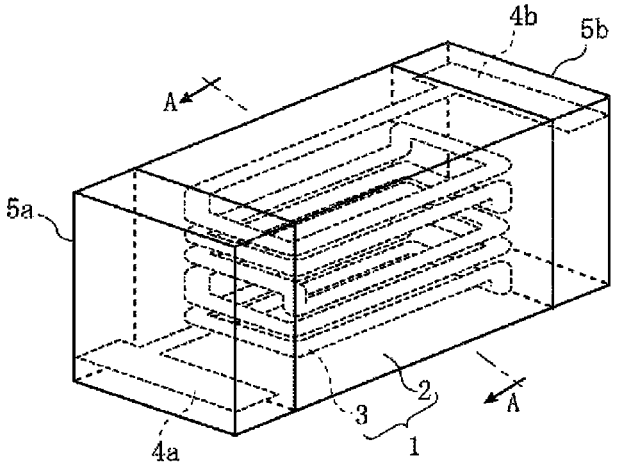
FIG. 1 is a perspective view showing an exemplary embodiment (first embodiment) of a laminated inductor as a laminated coil component.

The inventors realized that in the laminated chip inductor described in Patent Document 1, printing has to be performed by using alternately a plurality of pastes such as the magnetic paste and the non-magnetic paste in addition to the paste for an internal conductor, resulting in a complicated manufacturing process and lack of practicality. Furthermore, in the case where the magnetic paste and the non-magnetic paste have different component systems, residual stress is generated in firing both the pastes simultaneously due to the difference in shrinkage behavior, and there is a possibility that defects such as cracks develop.

Also, in Patent Document 2, since printing has to be performed by preparing a plurality of magnetic pastes having different compositions, or the magnetic paste and the non-magnetic paste, as with Patent Document 1, the manufacturing process is complicated and lacks practicality.

Moreover, the inventors realized that in the method of Patent Document 3, because a sintering modifier is mixed in the conductive paste, there is a possibility that resistance of a conductor pattern obtained by sintering the conductive paste is inevitably increased and DC resistance (Rdc) is increased.

The present inventors made earnest investigations by using Cu for a conductor part and a Ni—Zn-based ferrite material for a magnetic body part, and consequently found that when Cu and a magnetic sheet to serve as a magnetic body part are simultaneously fired in a reducing atmosphere in which Cu is not oxidized, Cu is diffused into a ferrite raw material near the conductor part, and thereby, the content of CuO in a region near the conductor part (hereinafter, referred to as a "first region") is increased, and the sinterability of the first region is lowered compared with the sinterability of a region (hereinafter, referred to as a "second region") other than the first region. Hence, they obtained findings that when the difference in sinterability is made between the first region and the second region to make the sinterability of the first region lower than the sinterability of the second region, thermal shock resistance and DC superposition characteristics can be improved.

That is, in order to improve the thermal shock resistance and the DC superposition characteristics, it is desirable to make the difference in sinterability between the first region and the second region, and for this purpose, it is necessary to suppress the grain growth of a crystal grain in the first region in firing.

Then, the present inventors further made earnest investigations in order to suppress the grain growth of a crystal grain in the first region in firing, and consequently found that by suppressing the grain growth of a crystal grain in the first region so that the ratio of the average crystal grain size in the first region to the average crystal grain size in the second region is 0.85 or less, moderate difference in sinterability can be made between the first region and the second region, and thereby, the thermal shock resistance and the DC superposition characteristics can be improved.

As a result of earnest investigations by the present inventors, it was found that by setting the weight ratio of Cu contained in the second region to Cu contained in the first region to 0.6 or less (including 0) in terms of CuO, the grain size ratio becomes 0.85 or less and therefore the difference in sinterability can be made between the first region and the second region.

Next, exemplary embodiments of a laminated inductor according to the present disclosure will be described in detail.

Figure 2:
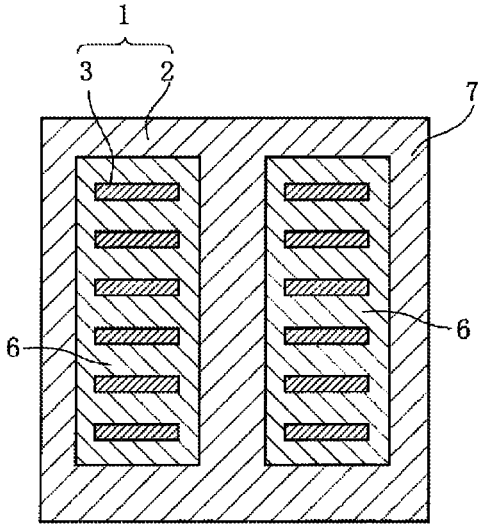
FIG. 2 is a sectional view (transverse sectional view) taken on line A-A of FIG. 1.

FIG. 1 is a perspective view showing an exemplary embodiment of a laminated inductor as a laminated coil component, and FIG. 2 is a sectional view (transverse sectional view) taken on line A-A of FIG. 1.

In the present laminated inductor, a component base 1 has a magnetic body part 2 and a coil conductor (conductor part) 3, and the coil conductor 3 is embedded in the magnetic body part 2. Further, extraction electrodes 4*a* and 4*b* are formed at both ends of the coil conductor 3, external electrodes 5*a* and 5*b* made of Ag or the like are formed at both ends of the component base 1, and the external electrodes 5*a* and 5*b* are electrically connected to the extraction electrodes 4*a* and 4*b*.

In the present embodiment, the magnetic body part 2 is formed from a ferrite material containing the respective components of Fe, Ni, Zn and Cu as main components, and the coil conductor 3 is formed from a conductive material containing Cu as a main component.

The magnetic body part 2 is, as shown in FIG. 2, divided into a first region 6 that is near the coil conductor 3 and a second region 7 other than the first region 6, and as shown in the equation (1), the ratio of the average crystal grain size D1 of the first region 6 to the average crystal grain size D2 of the second region 7 is set to 0.85 or less.

$$D1/D2 \leq 0.85 \quad (1)$$

Thereby, the second region 7 has good sinterability because of grain growth promoted during firing, and forms a high-density region with a high sintered density, and on the other hand, the first region 6 forms a low-density region with a low sintered density which is inferior in sinterability to the second region 7 and in which the grain growth of a crystal grain is suppressed.

That is, in the first region 6, the average crystal grain size is smaller than that in the second region 7, and the grain growth is suppressed during firing, resulting in low sinterability, and the sintered density is lowered. Therefore, internal stress can be mitigated and the fluctuation of the magnetic characteristics such as inductance can be suppressed even when thermal shock or external stress is loaded.

Further, since the first region 6, as described above, has low sinterability, the magnetic permeability μ is reduced and the DC superposition characteristics are improved, and thereby, concentration of a magnetic flux is largely mitigated, and magnetic saturation hardly occurs.

In addition, when the grain size ratio D1/D2 between the average crystal grain size D1 in the first region 6 and the average crystal grain size D2 in the second region 7 exceeds 0.85, the adequate difference in sinterability is not produced between the first region 6 and the second region 7 even if the grain size ratio D1/D2 is 1 or less, and when the grain size ratio D1/D2 exceeds 1, since the sinterability of the first region 6 becomes higher than that of the second region 7 because of the grain growth promoted more than in the second region 7, it is not preferable.

Further, by setting the molar content of Cu in the magnetic body part 2 to 6 mol % or less (including 0 mol %) in terms of CuO and firing the magnetic body part 2 in a reducing atmosphere in which the oxygen partial pressure is an equilibrium oxygen partial pressure of Cu—$Cu_2O$ or less to avoid oxidation of Cu, it becomes possible to control easily the grain size ratio D1/D2 so as to be 0.85 or less.

That is, in the case of firing a Ni—Zn—Cu-based ferrite material in the atmosphere, when the content of CuO having a low melting point of 1026° C. is reduced, sinterability is deteriorated, and therefore firing is usually performed at a firing temperature of about 1050 to 1250° C.

On the other hand, when the coil conductor 3 contains Cu as a main component, it is necessary to simultaneously fire the coil conductor 3 and the magnetic body part 2 in the reducing atmosphere in which Cu is not oxidized.

However, when the oxygen concentration in a firing atmosphere is lowered, oxygen defects are formed in a crystal structure by a firing treatment, the interdiffusion of Fe, Ni, Cu and Zn existing in a crystal is promoted, and thereby, low-temperature sinterability can be improved.

However, when firing is performed in such a reducing atmosphere of a low-oxygen concentration, a Cu oxide is easily deposited as a heterophase in a crystal grain compared with the case where firing is performed in the atmosphere. Accordingly, when the molar content of Cu in the ferrite raw material becomes high, an amount of the Cu oxide deposited in a crystal grain is increased, and the sinterability of the entire magnetic body part 2 is deteriorated conversely due to the deposition of the Cu oxide.

That is, when the coil conductor 3 contains Cu as a main component, it is necessary to simultaneously fire the coil conductor 3 and the magnetic body part 2 in the reducing atmosphere in which Cu is not oxidized, but in this case, if the molar content of Cu is increased and exceeds 6 mol % in terms of CuO, the amount of a Cu oxide deposited in a crystal grain becomes excessive, and therefore the grain growth of a crystal grain is suppressed also in the second region 7 and desired low-temperature firing cannot be performed.

On the other hand, when the molar content of Cu is set to 6 mol % or less in terms of CuO and firing is performed in a reducing atmosphere in which the oxygen partial pressure is an equilibrium oxygen partial pressure of Cu—$Cu_2O$ or less to avoid oxidation of Cu, Cu contained in the coil conductor 3 in the firing process is diffused into the first region 6. Therefore, the weight content of a Cu oxide around the coil conductor 3 is increased after firing, and consequently sinterability is deteriorated in the first region 6 to suppress the grain growth, the average crystal grain size becomes small, and the sintered density is lowered. On the other hand, the second region 7 can maintain good sinterability since it is not affected by diffusion of Cu.

As described above, a difference in the grain size is generated due to the difference in sinterability between the first region 6 and the second region 7, the average crystal grain size D1 of the first region 6 becomes smaller than the average crystal grain size D2 of the second region 7, and the grain size ratio D1/D2 can be made 0.85 or less.

Further, in this case, since Cu in the coil conductor 3 is diffused, the weight content x1 of CuO in the first region 6 becomes higher than the weight content x2 of the second region 7. Further, by performing firing in the reducing atmosphere in which Cu is not oxidized in the range of the molar content of Cu of 6 mol % or less in terms of CuO, the weight ratio x2/x1 of Cu contained in the second region 7 to Cu contained in the first region 6 can be controlled so as to be 0.6 or less, and thereby, a laminated inductor in which the grain size ratio D1/D2 is 0.85 or less can be obtained.

As described above, in the present embodiment, when the coil conductor 3 contains Cu as a main component, Cu in the coil conductor 3 is diffused into the first region 6 that is near the coil conductor 3 during a firing process, and consequently the weight content of the Cu oxide in the first region 6 is increased, and thereby, sinterability is deteriorated in the first region 6 in the magnetic body part 2. Further, since the grain growth is suppressed and the average crystal grain size is decreased in the first region 6, resulting in a coarse sintered state by providing a difference in sinterability between the first region 6 and the second region 7 to allow the grain size ratio D1/D2 to be 0.85 or less, internal stress can be mitigated and the fluctuation of the magnetic characteristics such as inductance can be suppressed even when thermal shock or external stress is loaded. Further, in the first region 6 with a low sintered density, since the magnetic permeability is also reduced, the DC superposition characteristics are improved, and consequently concentration of a magnetic flux is largely mitigated, and magnetic saturation hardly occurs.

In addition, the contents of the respective components for forming a main component other than Cu in the ferrite composition, namely, the contents of the respective components of Fe, Zn and Ni, are not particularly limited, but it is preferred that the contents of the respective components are 20 to 48 mol %, 6 to 33 mol %, and the rest in terms of $Fe_2O_3$, ZnO and NiO, respectively.

In the ferrite having a spinel type crystal structure such as Ni—Zn-based ferrite, a trivalent compound and a divalent compound are mixed in an equimolar amount in a stoichiometric composition, but when the amount of trivalent $Fe_2O_3$ is decreased moderately from the stoichiometric composition and NiO, a compound of a divalent element, is made present in excess of the stoichiometric composition, reduction of $Fe_2O_3$ is inhibited to prevent the formation of $Fe_3O_4$, and therefore it becomes possible to improve reduction resistance. That is, $Fe_3O_4$ can also be expressed by $Fe_2O_3$.FeO, if NiO which is a divalent Ni compound is present sufficiently in excess of the stoichiometric composition, formation of FeO having a valence of +2 similar to Ni is inhibited even when $Fe_3O_4$ is fired in an atmosphere of an equilibrium oxygen partial pressure of Cu—$Cu_2O$ or less, which is also a reducing atmosphere for $Fe_2O_3$, and consequently $Fe_2O_3$ can maintain the state of $Fe_2O_3$ without being reduced to $Fe_3O_4$, reduction resistance can be improved, and desired insulating properties can be secured.

Further, in a preferred embodiment, the ferrite material contains Mn in an amount of 1 to 10 mol % in terms of $Mn_2O_3$ as required. When the ferrite material contains Mn, since $Mn_2O_3$ is preferentially reduced, firing can be completed prior to reduction of $Fe_2O_3$, and further deterioration of the specific resistance ρ of the ferrite material can be avoided and the insulating property can be improved even in firing the ferrite material in the atmosphere of an equilibrium oxygen partial pressure of Cu—Cu2O or less.

That is, in the temperature range of 800° C. or higher, $Mn_2O_3$ comes into a reducing atmosphere at a higher oxygen partial pressure compared with $Fe_2O_3$. Accordingly, under the oxygen partial pressure of the equilibrium oxygen partial pressure of Cu—$Cu_2O$ or less, $Mn_2O_3$ comes into a strongly reducing atmosphere compared with $Fe_2O_3$, and therefore $Mn_2O_3$ is preferentially reduced to be able to complete firing. In other words, since $Mn_2O_3$ is preferentially reduced compared with $Fe_2O_3$, it becomes possible to complete firing treatment before $Fe_2O_3$ is reduced to $Fe_3O_4$, and therefore reduction resistance can be improved and more excellent insulating properties can be secured.

Figure 3:
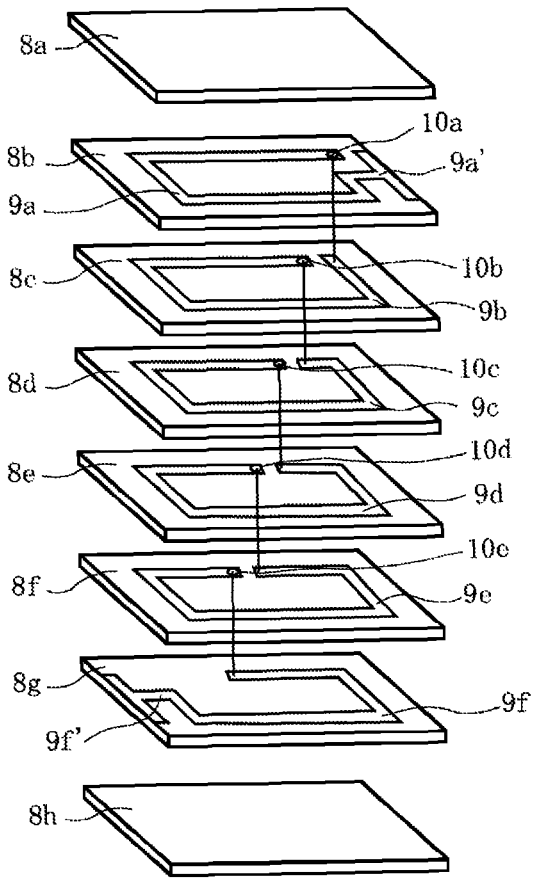
FIG. 3 is an exploded perspective view for illustrating an exemplary method for manufacturing the laminated inductor.

Next, an example of a method for manufacturing the laminated inductor will be described in detail in reference to FIG. 3.

First, as crude materials of ferrite, Fe oxides, Zn oxides, and Ni oxides, and further Mn oxides and Cu oxides, as required, are prepared. Then, these crude materials of ferrite are respectively weighed so as to be 20 to 48 mol %, 6 to 33 mol %, 1 to 10 mol %, 6 mol % or less and the rest in terms of $Fe_2O_3$, ZnO, $Mn_2O_3$, CuO, and NiO, respectively.

Then, these weighed materials are put in a pot mill together with pure water and balls such as PSZ (partially stabilized zirconia) balls, subjected to adequate wet mixing and grinding, and dried by evaporation, and then calcined at a temperature of 800 to 900° C. for a predetermined period of time.

Next, these calcined materials are put again in a pot mill together with an organic binder such as polyvinyl butyral, an organic solvent such as ethanol or toluene and PSZ balls, and subjected to adequate mixing and grinding to prepare a ferrite slurry.

Next, the ferrite slurry is formed into a sheet by using a doctor blade method or the like to prepare magnetic sheets 8*a* to 8*h* having a predetermined film thickness.

Then, via holes are formed at predetermined locations of the magnetic sheets 8*b* to 8*g* by use of a laser beam machine so that the magnetic sheets 8*b* to 8*g* of the magnetic sheets 8*a* to 8*h* can be electrically connected to one another.

Next, a conductive paste for a coil conductor containing Cu as a main component is prepared. Then, coil patterns 9*a* to 9*f* are formed on the magnetic sheets 8*b* to 8*g* by screen printing by using the conductive paste, and via hole conductors 10*a* to 10*e* are prepared by filling via holes with the conductive paste. In addition, extraction parts 9*a*' and 9*f*' are respectively formed at the coil patterns 9*a* and 9*f*, and respectively formed on the magnetic sheets 8*b* and 8*g* so as to be electrically connected to external electrodes.

Then, the magnetic sheets 8*b* to 8*g* having the coil patterns 9*a* to 9*f* formed thereon are laminated, and the resulting laminate is supported by sandwiching it between the magnetic sheets 8*a* and 8*h* on each of which the coil pattern is not formed, and press-bonded, and thereby, a press-bonded block, in which the coil patterns 9*a* to 9*f* are connected with the via hole conductors 10*a* to 10*e* interposed therebetween, is prepared. Thereafter, the press-bonded block is cut into a predetermined dimension to prepare a laminated formed body.

Next, the laminated formed body is adequately degreased at a predetermined temperature in an atmosphere in which Cu in the coil pattern is not oxidized, and then is supplied to a firing furnace in which the oxygen partial pressure is controlled by a mixed gas of $N_2$, $H_2$ and $H_2O$, and fired at 900 to 1050° C. for a predetermined time, and thereby, a component base 1, in which a coil conductor 3 is embedded in a magnetic body part 2, is obtained. That is, firing is performed by setting the firing atmosphere to an oxygen partial pressure of the equilibrium oxygen partial pressure of Cu—$Cu_2O$ or less within a firing temperature range of 900 to 1050° C.

In addition, in this firing treatment, Cu in the coil patterns 9*a* to 9*f* is diffused toward the magnetic sheets 8*b* to 8*g*, and thereby, the magnetic body part 2 is divided into the first region 6 with a low sintered density and the second region 7 having high sinterability and a high sintered density other than the first region 6.

Next, a conductive paste for an external electrode containing a conductive powder such as a Ag powder, glass frits, varnish and an organic solvent is applied onto both ends of the component base 1, and dried, and then baked at 750° C. to form external electrodes 5*a* and 5*b*, and thereby, a laminated inductor is prepared.

As described above, in the present embodiment, since the component base 1 is divided into the first region 6 near the coil conductor 3 and the second region 7 other than the first region 6, the grain size ratio of the average crystal grain size of the magnetic body part 2 in the first region 6 to the average crystal grain size of the magnetic body part 2 in the second region 7 is 0.85 or less, and the coil conductor 3 contains Cu as a main component, if the coil conductor 3 and the magnetic body part 2 are simultaneously fired in the reducing atmosphere in which Cu is not oxidized, Cu in the coil conductor 3 is diffused into the first region 6, and thereby, the weight content x1 of CuO in the first region 6 is increased, resulting in the deterioration of sinterability of the first region 6 compared with the sinterability of the second region 7, and therefore the grain size ratio can be easily made 0.85 or less.

As described above, in the first region 6, the sinterability is deteriorated and the grain growth during firing is suppressed compared with the second region 7, and consequently the magnetic permeability of the first region 6 is also deteriorated. Then, in the first region 6 near the coil conductor 3, because the sintered density is lowered because of the decrease in sinterability, internal stress can be mitigated, and the fluctuation of the magnetic characteristics such as inductance can be suppressed even when thermal shock or external stress is loaded due to the reflow treatment in mounting a component on a substrate or the like. Further, in the first region 6, because the magnetic permeability is reduced, the DC superposition characteristics are improved, and therefore concentration of a magnetic flux is largely mitigated, and the saturated magnetic flux density can be improved.

Further, by setting the content of Cu to 6 mol % or less (including 0 mol %) in terms of CuO, the grain size ratio can be easily made 0.85 or less without impairing the grain growth in the second region 7 even when firing is carried out in a reducing atmosphere in which Cu is not oxidized. Hence, it becomes possible to obtain a laminated coil component such as a laminated inductor having excellent thermal shock resistance and DC superposition characteristics while ensuring a high insulating property.

Further, by setting the weight ratio of Cu contained in the second region 7 to Cu contained in the first region 6 to 0.6 or less (including 0) in terms of CuO, the grain size ratio D1/D2 becomes 0.85 or less, and desired thermal shock resistance and DC superposition characteristics can be obtained.

Further, since the component base 1 is sintered in the atmosphere of the equilibrium oxygen partial pressure of Cu—$Cu_2O$ or less, the component base 1 can be sintered without oxidation of Cu even when the coil conductor 1 containing Cu as a main component is used and fired simultaneously with the magnetic body part 2.

As described above, in accordance with the present embodiment, it is possible to obtain a laminated coil component which has excellent thermal shock resistance that the changes in magnetic characteristics such as inductance are suppressed even when thermal shock or external stress is loaded, and has excellent DC superposition characteristics.

Figure 4:
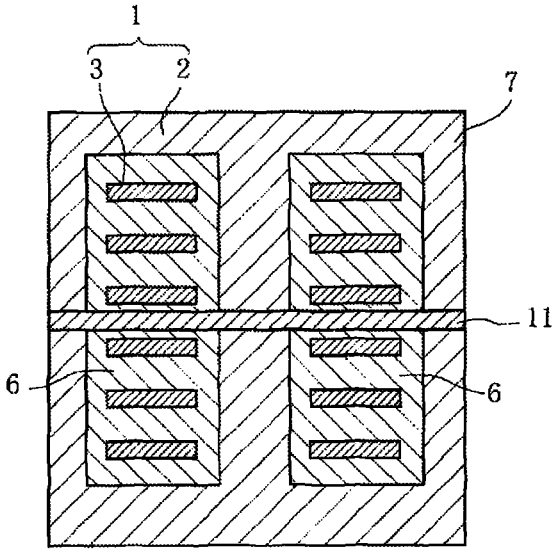
FIG. 4 is a transverse sectional view showing a second exemplary embodiment of the laminated inductor.

FIG. 4 is a transverse sectional view showing a second exemplary embodiment of the laminated coil component according to the present disclosure. In the second embodiment, it is preferred to provide a non-magnetic body layer 11 in such a manner as to cross a magnetic path to serve as an open magnetic circuit. By employing the open magnetic circuit, the DC superposition characteristics can be further improved.

Herein, as the non-magnetic body layer 11, materials having similar shrinkage behaviors in firing, for example, Zn—Cu-based ferrite obtained by substituting all Ni of Ni—Zn—Cu-based ferrite with Zn or Zn-based ferrite, can be used.

Embodiments consistent with the present disclosure are not limited to the above embodiment. In the above embodiment, the magnetic body part 2 is formed from a ferrite material containing the respective components of Fe, Ni, Zn and Cu as the main components, but it is also preferred that the Sn component is contained in an appropriate amount, e.g., 1 to 3 parts by weight in terms of $SnO_2$ with respect to 100 parts by weight of a main component, as an accessory component in the ferrite material, and thereby, the DC superposition characteristics can be further improved.

In the above embodiment, with respect to the firing atmosphere, firing is preferably performed in the atmosphere of an equilibrium oxygen partial pressure of Cu—$Cu_2O$ or less to avoid the oxidation of Cu serving as a coil conductor 3, as described above, but when the oxygen concentration is excessively low, specific resistance of the ferrite may be deteriorated, and the oxygen concentration is preferably a hundredth part of the equilibrium oxygen partial pressure of Cu—$Cu_2O$ or more from such a viewpoint.

A laminated coil component according to the present disclosure has been described, and it is needless to say that the present disclosure can be applied to laminated composite components such as a laminated LC component.

Next, examples of the present invention will be described specifically.

EXAMPLE 1: PREPARATION OF SAMPLE

Preparation of Magnetic Sheet: As crude materials of ferrite, $Fe_2O_3$, $Mn_2O_3$, ZnO, NiO and CuO were prepared, and these ceramic crude materials were respectively weighed so as to have the composition shown in Table 1. That is, the amounts of $Fe_2O_3$, $Mn_2O_3$ and ZnO were set to 46.5 mol %, 2.5 mol % and 30.0 mol %, respectively, and the amount of CuO was varied in a range of 0.0 to 8.0 mol %, and the rest was adjusted by NiO.

TABLE 1

| Sample | Ferrite Composition (mol %) | | | | |
|---|---|---|---|---|---|
| No. | $Fe_2O_3$ | $Mn_2O_3$ | ZnO | CuO | NiO |
| 1 | 46.5 | 2.5 | 30.0 | 0.0 | 21.0 |
| 2 | 46.5 | 2.5 | 30.0 | 1.0 | 20.0 |
| 3 | 46.5 | 2.5 | 30.0 | 2.0 | 19.0 |
| 4 | 46.5 | 2.5 | 30.0 | 3.0 | 18.0 |
| 5 | 46.5 | 2.5 | 30.0 | 4.0 | 17.0 |
| 6 | 46.5 | 2.5 | 30.0 | 5.0 | 16.0 |
| 7 | 46.5 | 2.5 | 30.0 | 6.0 | 15.0 |
| 8 | 46.5 | 2.5 | 30.0 | 7.0 | 14.0 |
| 9 | 46.5 | 2.5 | 30.0 | 8.0 | 13.0 |

Then, these weighed materials were put in a pot mill made of vinyl chloride together with pure water and PSZ balls, subjected to adequate wet mixing and grinding, and dried by evaporation, and then calcined at a temperature of 850° C.

Then, these calcined materials were put again in a pot mill made of vinyl chloride together with a polyvinyl butyral-based binder (organic binder), ethanol (an organic solvent), and PSZ balls, and subjected to adequate mixing and grinding to prepare a slurry.

Next, the slurry was formed into a sheet so as to have a thickness of 25 μm by using a doctor blade method, and the resulting sheet was punched out into a size of 50 mm in length and 50 mm in width to prepare a magnetic sheet.

Then, a via hole was formed at a predetermined location of the magnetic sheet by use of a laser beam machine, then a Cu paste containing a Cu powder, varnish and an organic solvent was applied onto the surface of the magnetic sheet by screen printing, and the Cu paste was filled into the via hole, and thereby, a coil pattern having a predetermined shape and a via hole conductor were formed.

Preparation of Non-magnetic Sheet: $Fe_2O_3$, $Mn_2O_3$ and ZnO were weighed so as to be 46.5 mol %, 2.5 mol % and 51.0 mol %, respectively, and calcined by the same method/procedure as previously described, and then calcined materials were formed into slurry, and thereafter, the slurry was formed into a sheet so as to have a thickness of 25 μm by using a doctor blade method, and the resulting sheet was punched out into a size of 50 mm in length and 50 mm in width to prepare a non-magnetic sheet.

Then, a via hole was formed at a predetermined location of the non-magnetic sheet by use of a laser beam machine, and then a Cu paste containing a Cu powder, varnish and an organic solvent was filled into the via hole, and thereby, a via hole conductor was formed.

Preparation of Sintered Body: The magnetic sheet having the coil pattern formed thereon, the non-magnetic sheet, and the magnetic sheet having the coil pattern formed thereon were laminated in turn so that the non-magnetic sheet is sandwiched between the magnetic sheets at substantially the center thereof, and thereafter the resulting laminate was sandwiched between the magnetic sheets not having the coil pattern, and these sheets were press-bonded at a pressure of 100 MPa at a temperature of 60° C. to prepare a press-bonded block. Then, the press-bonded block was cut into a predetermined size to prepare a laminated formed body.

Next, the laminated formed body was heated in a reducing atmosphere in which Cu is not oxidized, and adequately degreased. Thereafter, the ceramic laminated product was supplied to a firing furnace in which the oxygen partial pressure was controlled so as to be $1.8\times10^{-1}$ Pa by a mixed gas of $N_2$, $H_2$ and $H_2O$, and maintained at a firing temperature of 950° C. for 1 to 5 hours to be fired, and thereby, component bases of sample Nos. 1 to 9 having a non-magnetic body layer substantially in the center, in which a coil conductor was embedded in a magnetic body part, were prepared.

Next, a conductive paste for an external electrode containing a Ag powder, glass frits, varnish and an organic solvent was prepared. Then, the conductive paste for an external electrode was applied onto both ends of the ferrite body, and dried, and then baked at 750° C. to form external electrodes, and thereby, samples (laminated inductors) of the sample Nos. 1 to 9 were prepared.

With respect to the outer dimension of each sample, the length L was 2.0 mm, the width W was 1.2 mm, and the thickness T was 1.0 mm, and the number of coil turns was adjusted in such a way that the inductance was about 1.0 μH.

Evaluation of Samples: On each of samples of the sample Nos. 1 to 9, the weight content of CuO and the average crystal grain size were measured.

Figure 5:
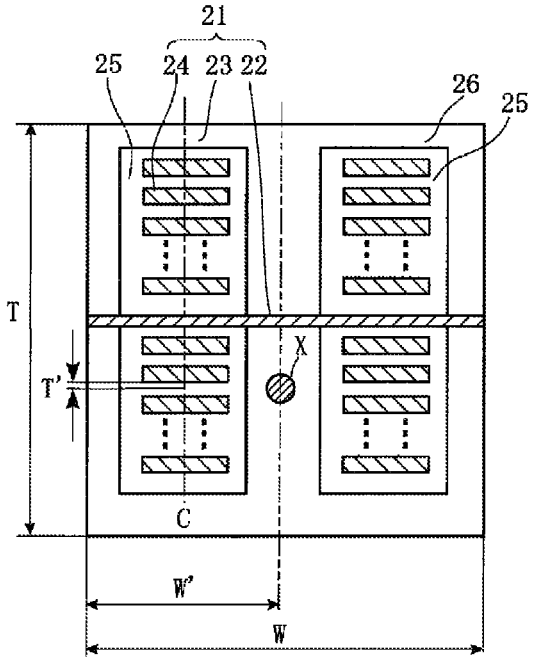
FIG. 5 is a drawing showing measuring points of the crystal grain size and composition in examples.

FIG. 5 is a sectional view showing measuring points of the weight content of CuO and the average crystal grain size, and in the component base 21 of each sample, a non-magnetic body layer 22 is formed substantially in the center, and a coil conductor 24 is embedded in a magnetic body part 23.

In the first region 25 near the coil conductor 24, a position, which is on the center line C of the coil conductors 24 and at distances T' of 5 μm from the coil conductors 24, was taken as a measurement position, and the weight content of CuO and the average crystal grain size at the measurement position were determined.

In the second region 26, a position (denoted by X in FIG. 5) in which W' corresponding to the center of the magnetic body part 23 of 1.2 mm in width W was 0.6 mm and which is approximately the center in the thickness direction is taken as a measurement position, and the weight content of CuO and the average crystal grain size at the measurement position were determined.

Specifically, the weight content of CuO was determined by fracturing 10 of each of samples of the sample Nos. 1 to 9, and quantitatively analyzing the composition of each magnetic body part 23 by using a WDX method (wavelength-dispersive X-ray spectroscopy) to determine the weight content of CuO (average value) in the magnetic body part 23 in the first region 25 and the second region 26.

With respect to the average crystal grain size of CuO, 10 of each sample were fractured, cross-sections were polished and chemically etched, a SEM photograph at the measurement point described above of each etched sample was taken, grain sizes in the first region 25 and the second region 26 were measured from the SEM photograph and converted to equivalent circle diameters according to JIS standard (R 1670), and the average crystal grain size was calculated to determine the average value of 10 samples.

Thereafter, a thermal shock test and a DC superposition test were performed, and inductances before and after the respective tests were measured to determine their change rates and evaluate the thermal shock resistance and the DC superposition characteristics.

Specifically, in the thermal shock test, 50 of each sample were subjected to a predetermined heat cycle test in the range of −55° C. to +125° C. 2000 times, and inductances L before and after the test were measured at a measurement frequency of 1 MHz to determine inductance change rates before and after the test.

Further, in the DC superposition test, on 50 of each sample, inductance L at the time when a DC current of 1 A was superposed on the sample was measured at a measurement frequency of 1 MHz according to JIS standard (C 2560-2) to determine inductance change rates ΔL before and after the test.

Table 2 shows measured results of each sample of the sample Nos. 1 to 9.

TABLE 2

| Sample No. | Molar Content of CuO (mol %) | Weight Content of CuO (weight %) First Region x1 | Weight Content of CuO (weight %) Second Region x2 | x2/x1 | Average Crystal Grain Size (μm) First Region D1 | Average Crystal Grain Size (μm) Second Region D2 | Grain Size Ratio D1/D2 |
|---|---|---|---|---|---|---|---|
| 1 | 0.0 | 4.35 | 0.00 | 0 | 1.1 | 1.3 | 0.85 |
| 2 | 1.0 | 4.75 | 0.68 | 0.14 | 1.2 | 2.4 | 0.50 |
| 3 | 2.0 | 5.08 | 1.35 | 0.27 | 1.1 | 2.6 | 0.42 |
| 4 | 3.0 | 5.48 | 2.01 | 0.37 | 1.1 | 2.6 | 0.42 |
| 5 | 4.0 | 5.82 | 2.69 | 0.46 | 1.0 | 2.1 | 0.48 |
| 6 | 5.0 | 6.31 | 3.37 | 0.53 | 1.1 | 1.9 | 0.58 |
| 7 | 6.0 | 6.68 | 4.00 | 0.60 | 1.0 | 1.4 | 0.71 |
| 8* | 7.0 | 6.98 | 4.70 | 0.67 | 1.0 | 1.0 | 1.00 |
| 9* | 8.0 | 7.31 | 5.36 | 0.73 | 1.0 | 1.0 | 1.00 |

| Sample No. | Inductance: Thermal Shock Test Initial Value (μH) | Thermal Shock Test Value after Test (μH) | Thermal Shock Test Change Rate ΔL (%) | DC Superposition Test Initial Value (μH) | DC Superposition Test Value after Test (μH) | DC Superposition Test Change Rate ΔL (%) |
|---|---|---|---|---|---|---|
| 1 | 0.98 | 1.11 | +13.3 | 0.98 | 0.62 | −36.7 |
| 2 | 1.21 | 1.25 | +3.3 | 1.21 | 0.91 | −24.8 |
| 3 | 1.25 | 1.29 | +3.2 | 1.25 | 0.96 | −23.2 |
| 4 | 1.29 | 1.35 | +4.7 | 1.29 | 0.95 | −23.4 |
| 5 | 1.22 | 1.29 | +5.7 | 1.22 | 0.86 | −29.5 |
| 6 | 1.11 | 1.20 | +8.1 | 1.11 | 0.75 | −32.4 |
| 7 | 0.99 | 1.13 | +14.1 | 0.99 | 0.61 | −38.4 |
| 8* | 0.92 | 1.11 | +20.7 | 0.92 | 0.50 | −45.5 |
| 9* | 0.91 | 1.15 | +26.4 | 0.91 | 0.43 | −52.4 |

*indicates out of the scope of the present disclosure

The sample Nos. 8 and 9 exhibited the inductance change rate ΔL as large as +20.7 to +26.4% in the thermal shock test, and the inductance change rate ΔL as large as −45.5 to −52.4% in the DC superposition test, and these samples were found to be inferior in the thermal shock resistance and the DC superposition characteristics. The reason for this is probably that the molar content of CuO is as high as 7.0 to 8.0 mol %, and therefore a heterophase of CuO was produced in a crystal grain to deteriorate the sinterability conversely, and the grain size ratio D1/D2 was 1.00.

On the other hand, in each of the sample Nos. 1 to 7, since the molar content of CuO was 6.0 mol % or less, the grain size ratio D1/D2 was 0.85 or less and the weight ratio x2/x1 was 0.60 or less, the inductance change rate ΔL was 15% or less in the absolute value in the thermal shock test, and the inductance change rate ΔL was 40% or less in the absolute value in the DC superposition test, and these samples were found to have good results.

Further, in each of the sample Nos. 2 to 6 in which the content of CuO was 1.0 to 5.0 mol %, since the grain size ratio D1/D2 was 0.6 or less and the inductance change rate was 10% or less in the absolute value in the thermal shock test, and these samples were found to have better results.

Figure 6:
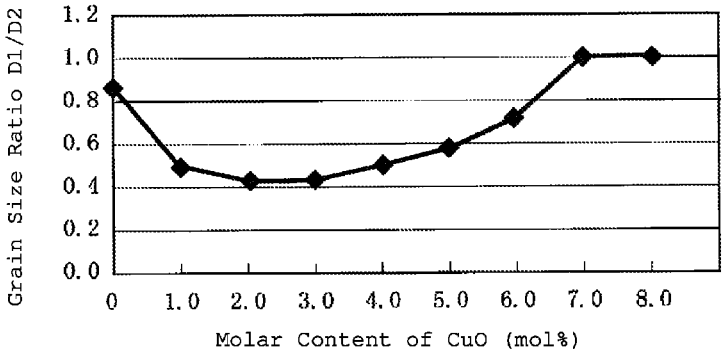
FIG. 6 is a graph showing a relation between the molar content of CuO and the grain size ratio.

FIG. 6 is a graph showing a relation between the molar content of CuO and the grain size ratio, and the horizontal axis represents the molar content (mol %) and the vertical axis represents the grain size ratio D1/D2 (–).

As is apparent from FIG. 6, it is found that the grain size ratio D1/D2 is 1.0 when the molar content of CuO exceeds 7.0 mol %, and on the other hand, the grain size ratio D1/D2 is 0.85 or less when the molar content of CuO is 6.0 mol % or less.

Figure 7:
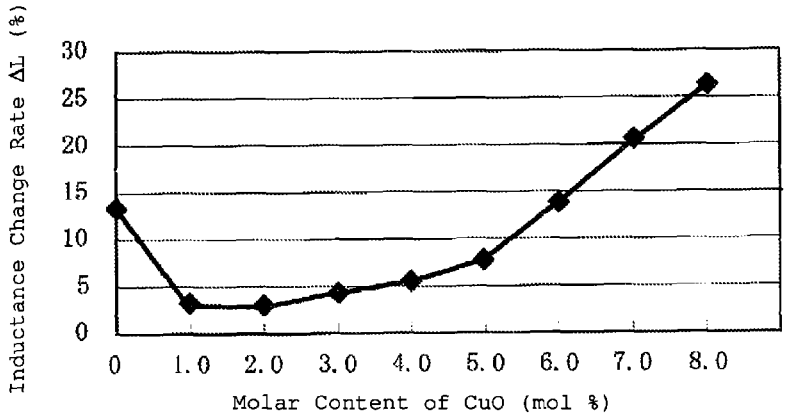
FIG. 7 is a graph showing a relation between the molar content of CuO and the inductance change rate in a thermal shock test.

FIG. 7 is a graph showing a relation between the molar content of CuO and the inductance change rate in a thermal shock test, and the horizontal axis represents the molar content (mol %) and the vertical axis represents the inductance change rate ΔL (%).

As is apparent from FIG. 7, it is found that the inductance change rate ΔL is 20% or more when the molar content of CuO exceeds 7.0 mol %, and on the other hand, the inductance change rate ΔL can be suppressed to 15% or less when the molar content of CuO is 6.0 mol % or less.

Figure 8:
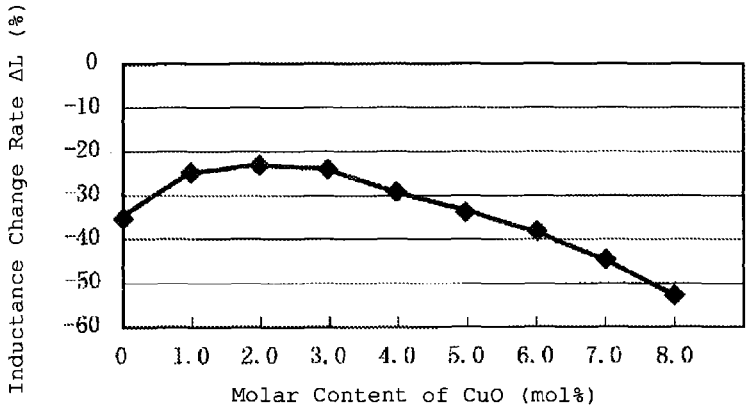
FIG. 8 is a graph showing a relation between the molar content of CuO and the inductance change rate in a DC superposition test.

FIG. 8 is a graph showing a relation between the molar content of CuO and the inductance change rate in a DC superposition test, and the horizontal axis represents the molar content (mol %) and the vertical axis represents the inductance change rate ΔL (%).

As is apparent from FIG. 8, it is found that the inductance change rate ΔL is more than 45% in the absolute value when the molar content of CuO exceeds 7.0 mol %, and on the other hand, the inductance change rate ΔL can be suppressed to 40% or less in the absolute value when the molar content of CuO is 6.0 mol % or less.

EXAMPLE 2

$Fe_2O_3$, $Mn_2O_3$, ZnO, NiO and CuO for forming the main components of the ferrite materials, and in addition $SnO_2$ as an accessory component material were prepared. Then, $Fe_2O_3$, $Mn_2O_3$, ZnO, CuO and NiO were weighed so as to be 46.5 mol %, 2.5 mol %, 30.0 mol %, 1.0 mol % and 20.0 mol %, respectively, and further, $SnO_2$ was weighed so as to be 0.0 to 3.0 parts by weight with respect to 100 parts by weight of the main component.

Except for these, samples of the sample Nos. 11 to 14 were prepared by following the same method/procedure as in Example 1.

Then, on each sample of the sample Nos. 11 to 14, the weight content of CuO and the average crystal grain size were measured to perform a thermal shock test and a DC superposition test.

Table 3 shows measured results of each sample of the sample Nos. 11 to 14.

TABLE 3

| Sample No. | Weight Content of $SnO_2$ (parts by weight) | Weight Content of CuO (weight %) First Region x1 | Second Region x2 | x2/x1 | Average Crystal Grain Size (μm) First Region D1 | Second Region D2 | Grain Size Ratio D1/D2 |
|---|---|---|---|---|---|---|---|
| 11* | 0.0 | 4.75 | 0.68 | 0.14 | 1.2 | 2.4 | 0.50 |
| 12 | 0.1 | 4.79 | 0.67 | 0.14 | 1.1 | 2.3 | 0.48 |
| 13 | 1.5 | 4.74 | 0.66 | 0.14 | 1.0 | 2.1 | 0.48 |
| 14 | 3.0 | 4.77 | 0.68 | 0.14 | 0.9 | 1.9 | 0.47 |

| Sample No. | Inductance: Thermal Shock Test Initial Value (μH) | Value after Test (μH) | Change Rate ΔL (%) | DC Superposition Test Initial Value (μH) | Value after Test (μH) | Change Rate ΔL (%) |
|---|---|---|---|---|---|---|
| 11* | 1.21 | 1.25 | 3.3 | 1.21 | 0.91 | −24.8 |
| 12 | 1.19 | 1.23 | 3.4 | 1.19 | 0.91 | −23.5 |
| 13 | 1.14 | 1.18 | 3.5 | 1.14 | 0.94 | −17.5 |
| 14 | 1.09 | 1.13 | 3.4 | 1.09 | 0.91 | −16.5 |

*indicates out of the scope of the present disclosure

As is evident from the sample Nos. 11 to 14, there is hardly any difference in the inductance change rate ΔL in the thermal shock test, but as is evident from the comparison between the sample Nos. 12 to 14 and the sample No. 11, it is found that the inductance change rate ΔL in the DC superposition test was reduced and the DC superposition characteristics were improved when $SnO_2$ was contained in the ferrite material. Moreover, it was found that in the range of the $SnO_2$ content of 0.1 to 3.0 parts by weight with respect to 100 parts by weight of a main component, the DC superposition characteristics are further improved as the $SnO_2$ content increases.

That is, it was verified that the DC superposition characteristics are further improved when an appropriate amount of $SnO_2$ is contained in the main component.

Industrial Applicability: Laminated coil components such as a laminated inductor, having excellent thermal shock resistance and DC superposition characteristics, can be realized without requiring a complicated process even when a material containing Cu as a main component is used for a coil conductor and the coil conductor and the magnetic body part are simultaneously fired.

With the laminated coil component, in the laminated coil component having a magnetic body part made of a ferrite material and a conductor part wound into a coil shape, the conductor part being embedded in the magnetic body part to form a component base, since the component base is divided into a first region near the conductor part and a second region other than the first region, the grain size ratio of the average crystal grain size of the magnetic body part in the first region to the average crystal grain size of the magnetic body part in the second region is 0.85 or less, and the conductor part contains Cu as a main component, the grain growth in the first region during firing is suppressed compared with the second region, resulting in the reduction in sinterability, and the magnetic permeability of the first region is also lower than that of the second region.

That is, in the first region near the conductor part, since the sintered density becomes lower than that of the second region because of a decrease in sinterability, internal stress can be mitigated, and the fluctuation of the magnetic characteristics such as inductance can be suppressed even when thermal shock or external stress is loaded due to the reflow treatment in mounting a component on a substrate or the like. Further, in the first region, since the magnetic permeability is reduced, the DC superposition characteristics are improved, and therefore concentration of a magnetic flux is largely mitigated, and the saturated magnetic flux density can be improved.

Further, a laminated coil component in which the grain size ratio is 0.85 or less can be easily attained by suppressing the content of Cu to 6 mol % or less (including 0 mol %) in terms of CuO, and performing firing in a reducing atmosphere in which the oxygen partial pressure is an equilibrium oxygen partial pressure of Cu—$Cu_2O$ or less to avoid oxidation of Cu.

Thereby, the grain size ratio can be easily made 0.85 or less without impairing the grain growth in the second region even when firing is carried out in a reducing atmosphere in which Cu is not oxidized, and it becomes possible to obtain a laminated coil component such as a laminated inductor having excellent thermal shock resistance and DC superposition characteristics while ensuring a high insulating property.

Further, in the reducing atmosphere in which Cu is not oxidized as described above, when the content of Cu exceeds 6 mol % in terms of CuO, the sinterability is deteriorated. Accordingly, by making a difference in the weight content of CuO between the first region and the second region, the difference in sinterability can be made.

Further, embodiments of a laminated coil component according to the present disclosure that include a ferrite material containing a Mn component make possible to further improve an insulating property.

Additionally, it is possible to further improve DC superposition characteristics of a laminated coil component when a ferrite material thereof contains a Sn component.

Moreover, an embodiment of a laminated coil component according to the present disclosure where the component base is preferably formed by being sintered in an atmosphere of an equilibrium oxygen partial pressure of Cu—$Cu_2O$ or less, even if a conductive film to serve as a conductor part containing Cu as a main component and the magnetic sheet to serve as a magnetic body part are simultaneously fired, the laminated coil component can be sintered without oxidation of Cu.

That which is claimed is:

1. A laminated coil component comprising:

a magnetic body part made of a ferrite material, a conductor part including a portion wound into a coil shape embedded in the magnetic body part, wherein a first region of the magnetic body part and a second region of the magnetic body part are disposed along a line perpendicular to a central axis of the coil-shape, the first region being disposed near the conductor part, the second region being spaced from the coil-shaped portion, the central axis of the coil-shape extends in a stacking direction of the laminated coil component, the grain size ratio of the average crystal grain size of the magnetic body part in the first region to the average crystal grain size of the magnetic body part in the second region is 0.85 or less and greater than 0, and the conductor part contains Cu as a main component.

2. The laminated coil component according to claim 1, wherein the conductor part includes an extraction part that leads out from the coil-shaped portion and leads to an external electrode.

3. The laminated coil component according to claim 1, wherein a content of Cu in the ferrite material is 6 mol % or less, inclusive of 0 mol %, in terms of CuO.

4. The laminated coil component according to claim 1, wherein a weight ratio of Cu contained in the second region to Cu contained in the first region is 0.6 or less, inclusive of 0, in terms of CuO.

5. The laminated coil component according to claim 1, wherein the ferrite material contains a Mn component.

6. The laminated coil component according to claim 5, wherein the ferrite material contains Mn in an amount of 1 to 10 mol % in terms of $Mn_2O_3$.

7. The laminated coil component according to claim 1, wherein the ferrite material contains a Sn component.

8. The laminated coil component according to claim 7, wherein the Sn component is 1 to 3 parts by weight in terms of $SnO_2$ with respect to 100 parts by weight of a main component.

9. The laminated coil component according to claim 1, wherein the laminated coil component is formed by being sintered in an atmosphere of an equilibrium oxygen partial pressure of Cu—$Cu_2O$ or less.

10. The laminated coil component according to claim 1, further comprising a non-magnetic sheet provided across the conductor part and having a major surface perpendicular to an axial direction of the coil shape.

11. The laminated coil component according to claim 1, wherein the second region substantially surrounds the first region.

12. A laminated coil component having a magnetic body part containing at least Fe, Mn, Zn and Ni, and a coil-shaped conductor containing Cu as a main component, wherein the coil-shaped conductor has a coil shape that is layered in a stacking direction, a first region of the magnetic body part and a second region of the magnetic body part are disposed along a line perpendicular to a central axis of the coil-shape, the first region being disposed near the coil-shaped conductor, the second region being spaced from the coil-shaped conductor, the central axis of the coil-shape extends in the stacking direction of the coil-shaped conductor, and a ratio of a content of Cu (in terms of CuO) in the second region to the content of Cu (in terms of CuO) in the first region of the magnetic body part near the conductor part is 0 to 0.6.

13. The laminated coil component according to claim 12, wherein the content of Cu in the second region of the magnetic body part is 0 to 6 mol % in terms of CuO.

14. The laminated coil component according to claim 12, further containing a non-magnetic body layer.

15. The laminated coil component according to claim 13, further containing a non-magnetic body layer.

* * * * *